US006459055B1

(12) United States Patent
Russell

(10) Patent No.: US 6,459,055 B1
(45) Date of Patent: Oct. 1, 2002

(54) ACCELERATION RESPONSIVE SWITCH

(75) Inventor: Stephen D. Russell, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/963,019

(22) Filed: Sep. 25, 2001

(51) Int. Cl.[7] ..... H01H 35/02

(52) U.S. Cl. ..... 200/61.45 R; 200/61.47; 200/61.48; 200/214; 200/215; 200/220

(58) Field of Search ..... 73/504.05, 514.03–514.09, 73/514.31–514.38, 521; 200/61.45 R, 51.47, 61.48, 61.51, 61.52, 61.53, 61.45 M, 220, 182, 214, 215, 600

(56) References Cited

U.S. PATENT DOCUMENTS

| | | | | | |
|---|---|---|---|---|---|
| 3,753,004 | A | | 8/1973 | Dominic | 307/121 |
| 4,419,650 | A | | 12/1983 | John | 337/119 |
| 4,544,408 | A | | 10/1985 | Mosser et al. | 106/14 |
| 4,548,646 | A | | 10/1985 | Mosser et al. | 106/14.12 |
| 4,676,103 | A | * | 6/1987 | Nakajima | 73/514.09 |
| 4,696,319 | A | | 9/1987 | Gant | 137/78.3 |
| 4,790,968 | A | | 12/1988 | Ohkawa et al. | 264/104 |
| 5,036,705 | A | * | 8/1991 | Gaines | 73/514.14 |
| 5,334,630 | A | | 8/1994 | Francis et al. | 523/216 |
| 5,450,931 | A | | 9/1995 | Masuda et al. | 188/268 |
| 5,503,777 | A | | 4/1996 | Itagaski et al. | 252/518 |
| 5,554,225 | A | | 9/1996 | DeMars | 118/669 |
| 5,600,109 | A | | 2/1997 | Mizutani et al. | 200/61.45 R |
| 5,688,441 | A | | 11/1997 | Itagaki et al. | 252/514 |
| 5,753,872 | A | | 5/1998 | Komiya et al. | 200/61.45 R |
| 5,828,138 | A | | 10/1998 | McIver et al. | 307/10.1 |
| 6,323,447 | B1 | * | 11/2001 | Kondoh et al. | 200/214 |

* cited by examiner

*Primary Examiner*—Michael Friedhofer
(74) *Attorney, Agent, or Firm*—Andrew J. Cameron; James A. Ward; Peter A. Lipovsky

(57) ABSTRACT

An acceleration responsive switch includes a material that changes from a high viscosity to a low viscosity when subjected to acceleration forces. The material's change in viscosity causes the switch to change from one state to another.

37 Claims, 10 Drawing Sheets

ACCELERATION RESPONSIVE SWITCH

BACKGROUND OF THE INVENTION

The present invention relates generally to the field of switches and more particularly to those types of switches that are actuated by acceleration forces.

Various types of acceleration responsive switches have been described in the prior art. For instance, U.S. Pat. No. 5,828,138 by McIver et al. discloses an acceleration switch wherein an inertial mass member is held in a holding position by an electrostatic force until the acceleration forces exerted upon it causes the inertial mass member to deflect to an actuated position. U.S. Pat. No. 5,600,109 by Mizutani et al. discloses an acceleration switch wherein acceleration forces cause an inertia ball to bridge one or more contacts located radially around the ball.

SUMMARY OF THE INVENTION

The present invention is a switch that changes between a first condition and a second condition in response to acceleration forces exerted upon it. The switch includes a material that changes from a high viscosity (first state) to a low viscosity (second state) when subjected to acceleration forces. The change in states results in the switch changing between its first and second conditions.

One embodiment of the invention is a normally-open, electrical switch with an open and closed condition. The switch includes a movable contact that is movable from an open position to a closed position. The switch also includes a mechanism, such as a spring, for biasing this movable contact towards the closed position. Thixotropic material in the switch is positioned so that it prevents the movable contact from moving to the closed position while the material is in its first state, keeping the switch in its open condition. When the material is subjected to acceleration forces, the material changes to its second state and allows the movable contact to move to its closed position, where the movable contact provides a conductive path for the switch to change to its closed conductive condition.

Another embodiment of the invention is a normally-closed electrical switch with a movable contact that is movable from a closed position to an open position. While in the closed position, the movable contact provides a conductive path for the switch to remain in the closed conductive condition. The switch also includes a mechanism, such as a spring, for biasing the movable contact towards the open position. Thixotropic material prevents the movable contact from moving to its open position while the material is in its first state. When the material is subjected to acceleration forces the material changes to its second state and allows the movable contact to move to its open position, interrupting the conductive path between a stationary contact and the movable contact, causing the switch to change to its open non-conductive condition.

In another embodiment of the invention, a normally-open electrical switch includes electrically conductive thixotropic material. The switch also includes a reservoir for retaining this material away, and electrically isolating it from stationary contacts. While the material is in the reservoir, the switch remains in its open, non-conductive condition. When subjected to acceleration forces, the material changes to its second state and flows out of the reservoir and into electrical contact with the stationary contacts, where the material itself provides the conductive path for the switch to change to its closed conductive condition.

In yet, another embodiment of the invention a normally-closed electrical switch includes conductive thixotropic material. The material provides a conductive path between stationary contacts, keeping the switch in its closed, conductive condition while the material is in its first state. When subjected to acceleration force, the material changes to its second state and flows out of contact with the stationary contacts, interrupting the conductive path and causing the switch to change to its open, non-conductive condition.

Another embodiment of the invention is a normally closed fluidic switch that changes from a closed, non-fluid flowing condition to an open fluid flowing condition. The switch includes a thixotropic material which is positioned in a tube, such that a fluid is prevented from flowing through the tube while the material is in its first state, keeping the switch in its closed condition. When the material is subjected to acceleration forces, the material changes to its second state and flows out of the tube and into a reservoir, allowing the fluid to flow freely through the tube and causing the switch to change to its open condition.

Yet, another embodiment of the invention is a normally open, magnetic switch with a magnetic sensor and a movable magnet that is movable from a first position to a second position. The switch also includes a mechanism, such as a spring, for biasing the movable magnet towards the second position. Thixotropic material is also included in this switch and is positioned so that it prevents the movable magnet from moving to the second position while the material is in its first state, keeping the switch in its open condition. When the material is subjected to acceleration forces, the material changes to its second state and allows the movable magnet to move to its second position where it is detectable by the magnetic sensor, causing the switch to change to its second condition.

Still, another embodiment of the current invention is a normally closed magnetic switch with a magnetic sensor and a movable magnet that is movable from a first position to a second position. The switch also includes a mechanism, such as a spring, for biasing the movable magnet towards the second position. The switch further includes thixotropic material positioned so that it prevents the movable magnet from moving to the second position while the material is in its first state, keeping the switch in its second condition. When the material is subjected to acceleration forces the material changes to its second state and allows the movable magnet to move to its open position where the magnet is not detectable by the magnetic sensor, causing the switch to change to its open condition.

Another embodiment of the invention is a capacitive switch that has a first and second condition, where the capacitance of the switch is higher in the second condition than it is in the first. The switch includes first and second spaced conductive plates. The second conductive plate is movable from a first position to a second position where the second plate is spaced closer to the first plate in the second position than it is in the first position. The switch also includes a mechanism, such as a spring, for biasing the second conductive plate towards its second position. The switch also includes thixotropic material, disposed so that it prevents the second conductive plate from moving to its second position while the material is in its first state, keeping the switch in its first condition. When the material is subjected to acceleration forces, the material changes to its second state and allows the second conductive plate to move to its second position changing the switch to its second condition.

Another embodiment of the invention is a capacitive switch that has a first and second condition, where the capacitance of the switch is lower in the second condition than it is in the first. The switch includes first and second spaced, conductive plates. The second conductive plate is movable from a first position to a second position where the second plate is spaced farther from the first plate in the second position than it is in the first. The switch also includes a mechanism, such as a spring, for biasing the second conductive plate towards its second position. The switch further includes the previously described thixotropic material, disposed so that it prevents the second conductive plate from moving to its second position while the material is in its first state, keeping the switch in its first condition. When the material is subjected to acceleration forces, the material changes to its second state and allows the second conductive plate to move to its second position changing the switch to its second condition.

Another embodiment of the invention is a capacitive switch that has a first and second condition, where the capacitance of the switch is higher in the second condition than it is in the first. The switch includes first and second spaced, conductive plates. The switch includes thixotropic material that has the property of being substantially non-conductive. The material is disposed in a first location, between the plates, while the material is in its first state, keeping the switch in its first condition. When the material is subjected to acceleration forces the material changes to its second state and flows to a second location, outside of the conductive plates, changing the switch to its second condition.

Another embodiment of the invention is a capacitive switch that has a first and second condition, where the capacitance of the switch is lower in the second condition than it is in the first. The switch includes a first and second conductive plate facing and spaced apart. The switch also includes non-conductive thixotropic material. The switch further includes a reservoir for retaining the material outside of the conductive plates while the material is in its first state, keeping the switch in its first condition. When the material is subjected to acceleration forces the material changes to its second state and flows out of the reservoir and to a location between the conductive plates, changing the switch to its second condition.

An advantage of the switch is that it is non-reversible. That is, once the switch changes conditions, it would require significant effort to reset the switch. Therefore, the switch may be used in a fuse or anti-fuse application.

Another advantage is that the switch changes conditions without the use of electrical power, making it useful in applications deployed in remote or inaccessible locations.

Still, another advantage of the switch is that the switch may be made by micro fabrication techniques, significantly reducing size, weight, and cost over modern acceleration responsive switches.

The previously summarized features and advantages along with other aspects of the present invention will become clearer upon review of the following specification taken together with the included drawings.

DESCRIPTION OF THE INVENTION

The material mentioned previously is commonly referred to as "thixotropic" material. Thixotropic materials generally are materials that change from a solid state to a fluid state when exposed to acceleration forces. Typically, they are colloidal gels, which liquefy when agitated by shaking or by ultrasonic vibration and return to the gel state when at rest. Examples of commercially available thixotropic materials and additives to create thixotropic materials which can be used in an acceleration responsive switch include a thixotropic material sold under the trademark "Disparlon", by King Industries and synthetic precipitated silica thixotropic materials, Hi-Sil® T-600 and Hi-Sil® T-700, sold by PPG Industries, Incorporated. Further included is the additive by Dow Corning, "Thixo,A-300-1", which is added to silicone to make a thixotropic material. RBC Industries makes available electrically conductive thixotropic materials, "RBC-6200" and "RBC-6400". Further information on thixotropic materials is provided in U.S. Pat. No. 5,503,777 by Itagaki et al., U.S. Pat. No. 5,334,630 by Francis et al., and U.S. Pat. No. 4,544,408 by Mosser et al. It is to be understood that the above examples are for illustrative purposes and are by no means intended to be limiting.

Figure 1A:
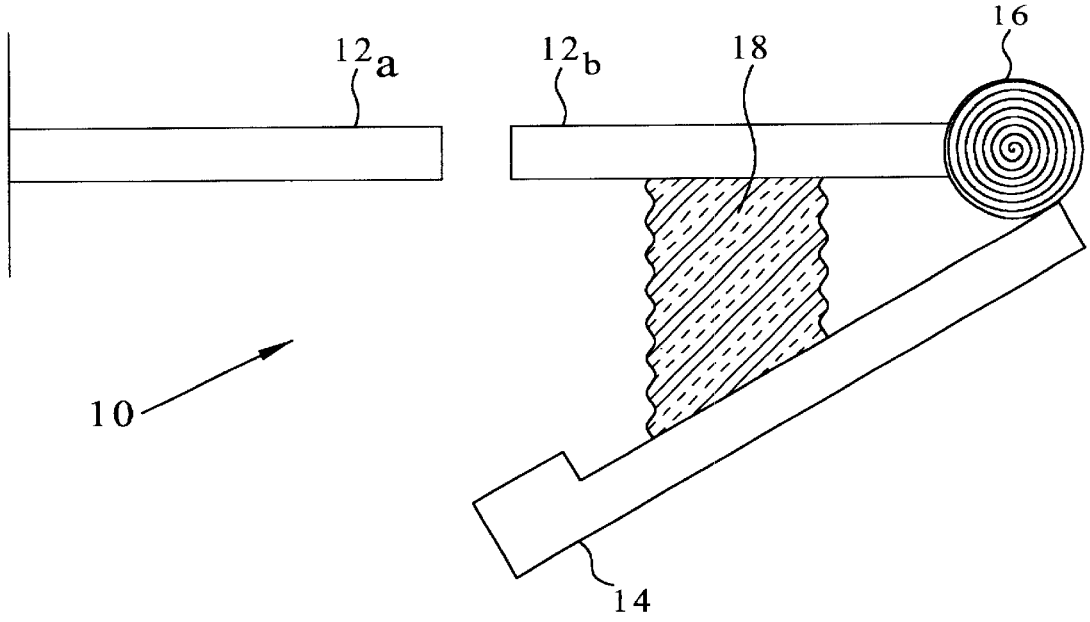
FIGS. 1(*a*) and 1(*b*) are diagrams showing the open and closed conditions, respectively, of a first acceleration responsive switch.
Figure 1B:
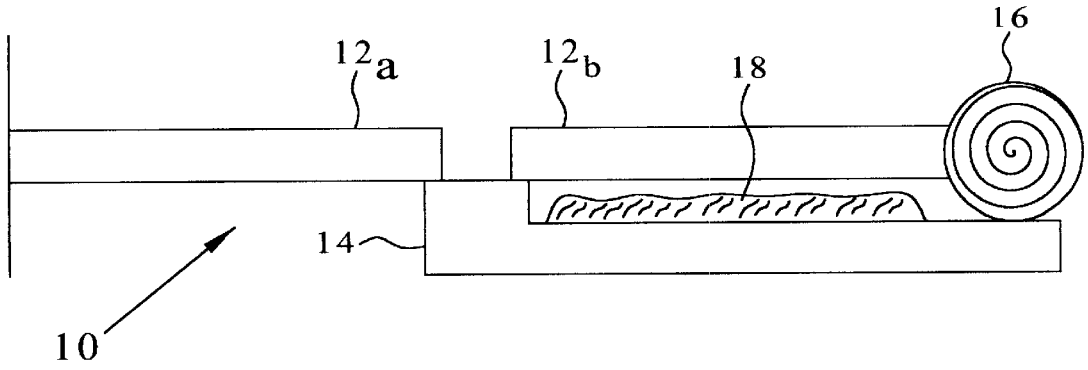

A first embodiment of an acceleration responsive switch is shown in FIGS. 1(*a*) and 1(*b*). FIG. 1(*a*) shows an electrical switch 10 in its normally open, non-conductive condition and FIG. 1(*b*) shows it in its actuated closed, conductive condition. The switch 10 includes two stationary contacts 12*a* and 12*b* and a movable contact 14, that is movable from an open position, as shown in FIG. 1(*a*), to a closed position, as in FIG. 1(*b*). While movable contact 14 is in its closed position, as shown in FIG. 1(*b*), it provides a conductive path with stationary contacts 12*a* and 12*b*.

Still referring to FIGS. 1(*a*) and 1(*b*), the switch 10 includes a mechanism for biasing movable contact 14 towards its closed position. By way of example, a spring 16 is attached to movable contact 14 so that the movable contact is biased towards stationary contacts 12*a* and 12*b*. Also included is a material 18 that has the characteristic of changing from a high viscosity (first state) to a low viscosity (second state) in response to acceleration forces. This material 18 is disposed so that it prevents the movable contact 14 from moving to its closed position. By way of example, FIG. 1(*a*) shows material 18 disposed between movable contact 14 and stationary contact 12*b*, preventing movable contact from closing while material 18 is in its first state, keeping switch 10 in its open non conductive condition. When the acceleration responsive switch 10 is subjected to acceleration forces, material 18 changes to its second state and movable contact 14 is allowed to move to its closed position, as shown in FIG. 1(*b*), changing switch 10 to its closed conductive condition.

Figure 2A:
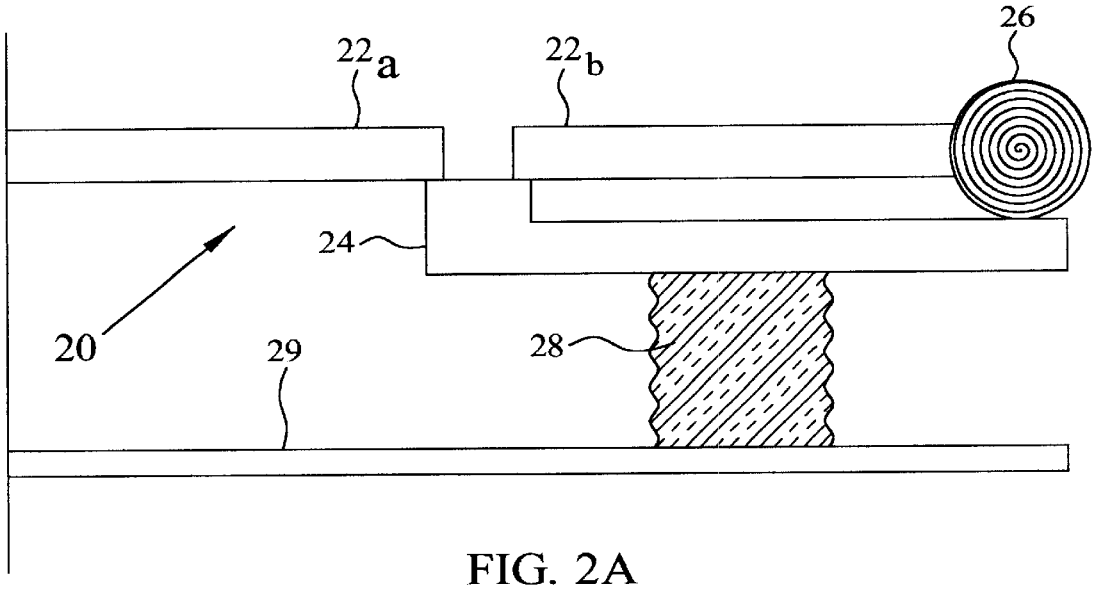
FIGS. 2(*a*) and 2(*b*) are diagrams showing the closed and open conditions, respectively, of a second acceleration responsive switch.
Figure 2B:
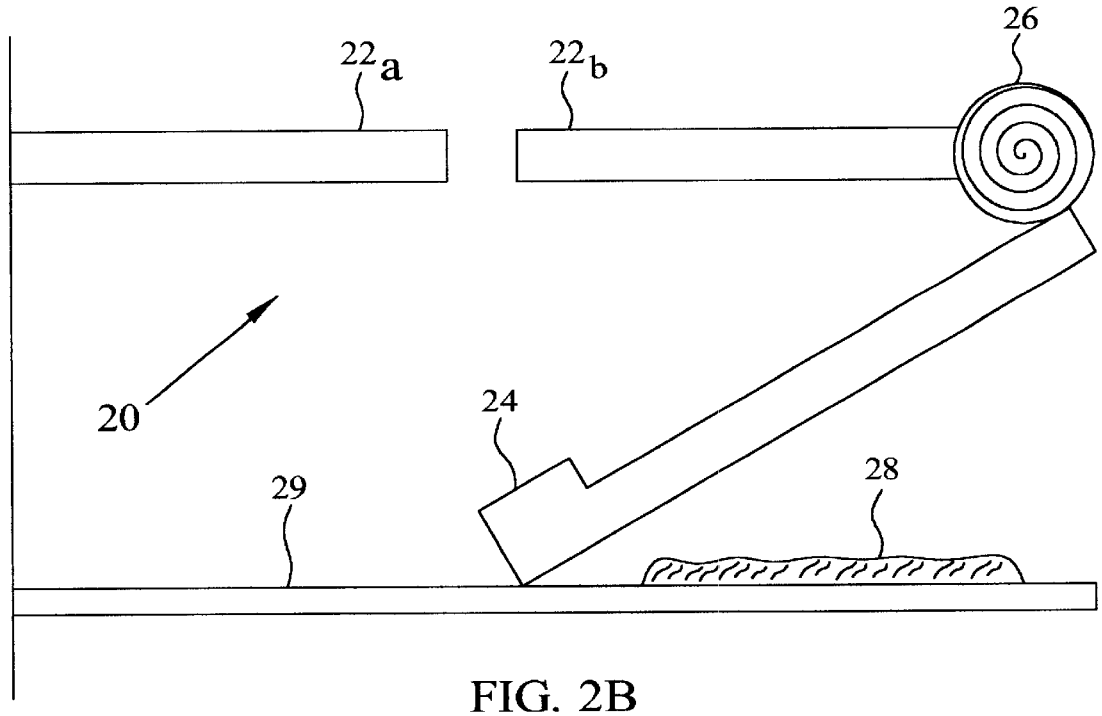

A second embodiment of the invention is shown in FIGS. 2(*a*) and 2(*b*). FIG. 2(*a*) shows electrical switch 20 in its normally closed, conductive condition and FIG. 2(*b*) shows it in its actuated open, non-conductive condition. The electrical switch 20 includes two stationary contacts 22*a* and 22*b* and a movable contact 24, that is movable from a closed position, as shown in FIG. 2(*a*), to an open position, as shown in FIG. 2(*b*). While movable contact 24 is in its closed position, as shown in FIG. 2(*a*), it provides a conductive path with stationary contacts 22*a* and 22*b*.

The switch 20 further includes a mechanism for biasing movable contact 24 towards its open position. By way of example, FIGS. 2(*a*) and 2(*b*) show a spring 26 attached to movable contact 24, biasing it towards its open position. Also included is material 28, which like the previously described material, changes viscosity in response to acceleration forces. Material 28 is disposed so that it prevents movable contact 24 from moving to its open position, while material 28 is in its first state. By way of example, FIG. 2(*a*) shows material 28 disposed between movable contact 24 and switch housing 29 in order to prevent movable contact from moving to its open position while material 28 is in its first state, keeping switch 20 in its closed conductive condition. When switch 20 is subjected to acceleration forces, material 28 changes to its second state and movable contact 24 is allowed to move to its open position, as shown in FIG. 2(*b*), changing switch 20 to its open, non-conductive condition.

Figure 3A:
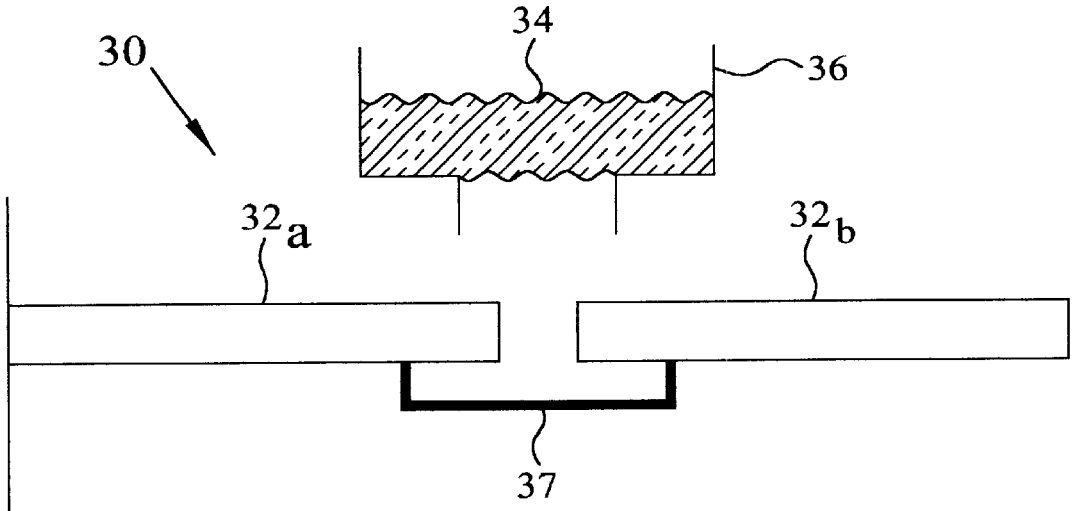
FIGS. 3(*a*) and 3(*b*) are diagrams showing the open and closed conditions respectively, of a third acceleration responsive switch.
Figure 3B:
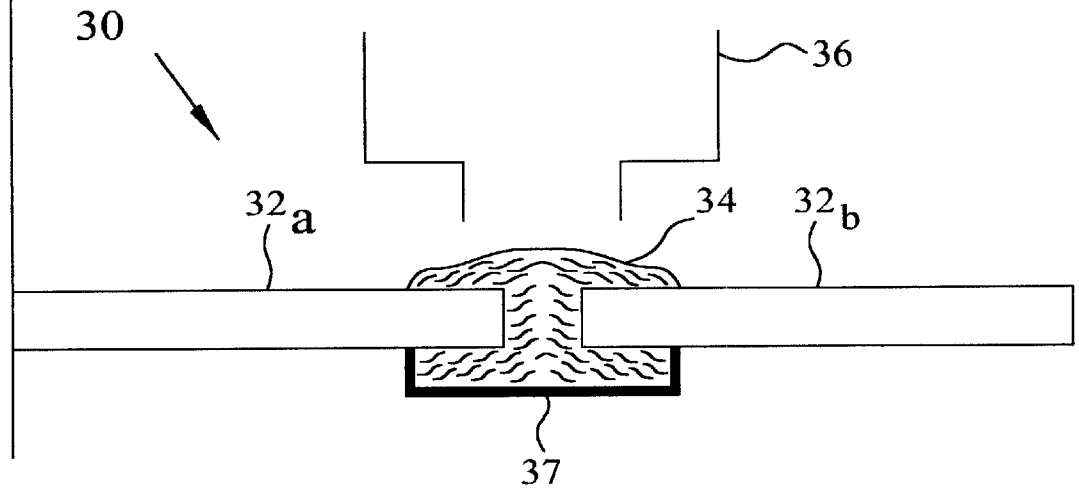

A third embodiment of an acceleration responsive switch is shown in FIGS. 3(*a*) and 3(*b*). FIG. 3(*a*) shows electrical switch 30 in its normally open, non-conductive condition and FIG. 3(*b*) shows it in its actuated closed, conductive condition. The switch 30 includes two stationary contacts 32*a* and 32*b*. The switch 30 also includes a conductive material 34, that changes from a high viscosity (first state) to a low viscosity (second state) in response to acceleration forces. FIG. 3(*a*) shows conductive material 34 retained away and electrically isolated from stationary contacts 32*a* and 32*b* by reservoir 36. Conductive material 34 remains in reservoir 36 while conductive material 34 is in its first state, keeping switch 30 in its open non-conductive condition. When subjected to acceleration forces, conductive material 34 changes to its second state and flows out of reservoir 36 to another reservoir 37, so that the conductive material 34 creates a conductive path with stationary contacts 32*a* and 32*b*, as shown in FIG. 3(*b*), causing switch 30 to change to its closed conductive condition. By way of example, FIG. 3(*b*) shows a non-conductive reservoir 37, located below stationary contacts 32*a* and 32*b*, for retaining conductive material 34 after it flows from reservoir 36.

Figure 4A:
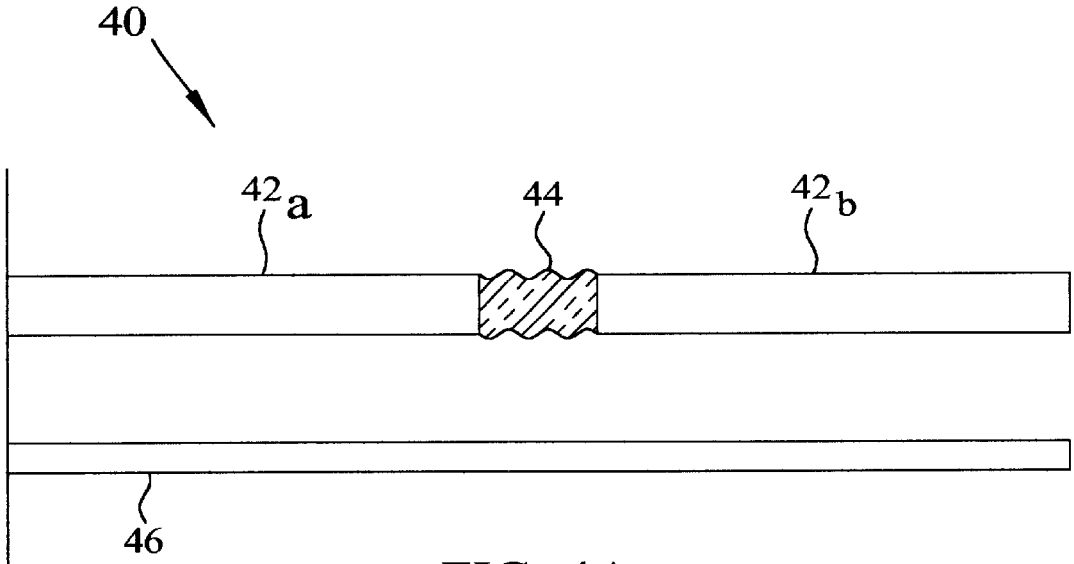
FIGS. 4(*a*) and 4(*b*) are diagrams showing the closed and open conditions, respectively, of a fourth acceleration responsive switch.
Figure 4B:
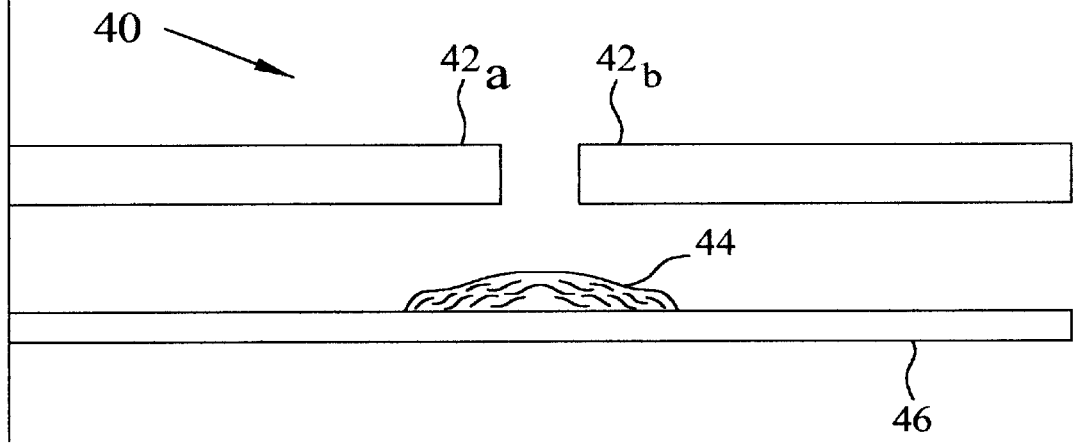

A fourth embodiment of an acceleration responsive switch is shown in FIGS. 4(*a*) and 4(*b*). FIG. 4(*a*) shows electrical switch 40 in its normally closed, conductive condition and FIG. 4(*b*) shows it in its actuated open, non-conductive condition. The switch 40 includes two stationary contacts 42*a* and 42*b*. Also included is conductive material 44, which like the previous material changes viscosity in response to acceleration forces. FIG. 4(*a*) shows conductive material 44 disposed so that it forms a conductive path with stationary contacts 42*a* and 42*b*, while conductive material 44 is in its first state, keeping switch 40 in its closed conductive condition. When switch 40 is subjected to acceleration forces, conductive material 44 changes to its second state and flows out of contact with stationary contacts 42*a* and 42*b*. By way of example, conductive material 44 flows to switch housing 46 when subjected to acceleration forces, as shown in FIG. 4(*b*), causing switch 40 to change to its open non-conductive condition.

Figure 5A:
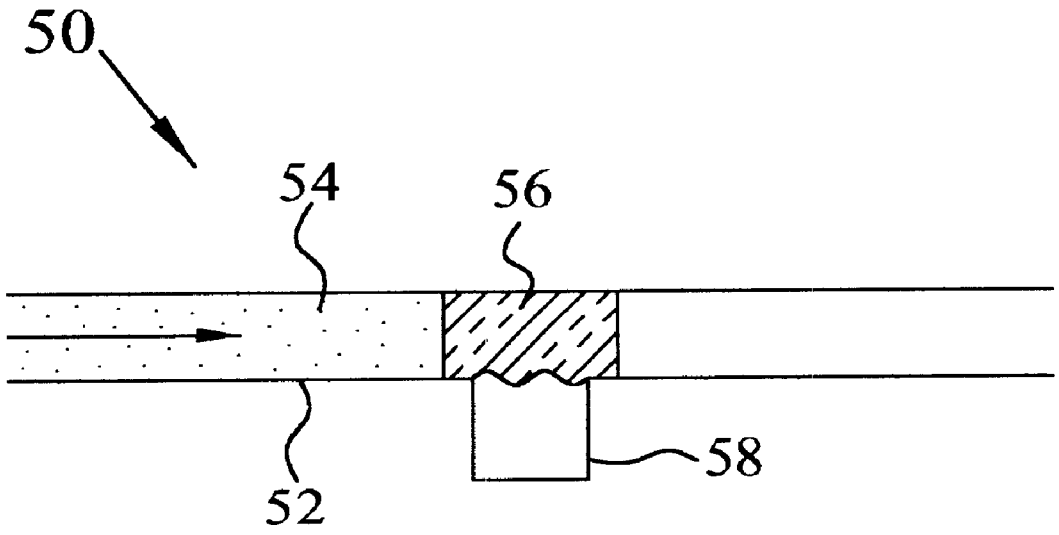
FIGS. 5(*a*) and 5(*b*) are diagrams showing the closed and open conditions, respectively, of a fifth acceleration responsive switch.
Figure 5B:
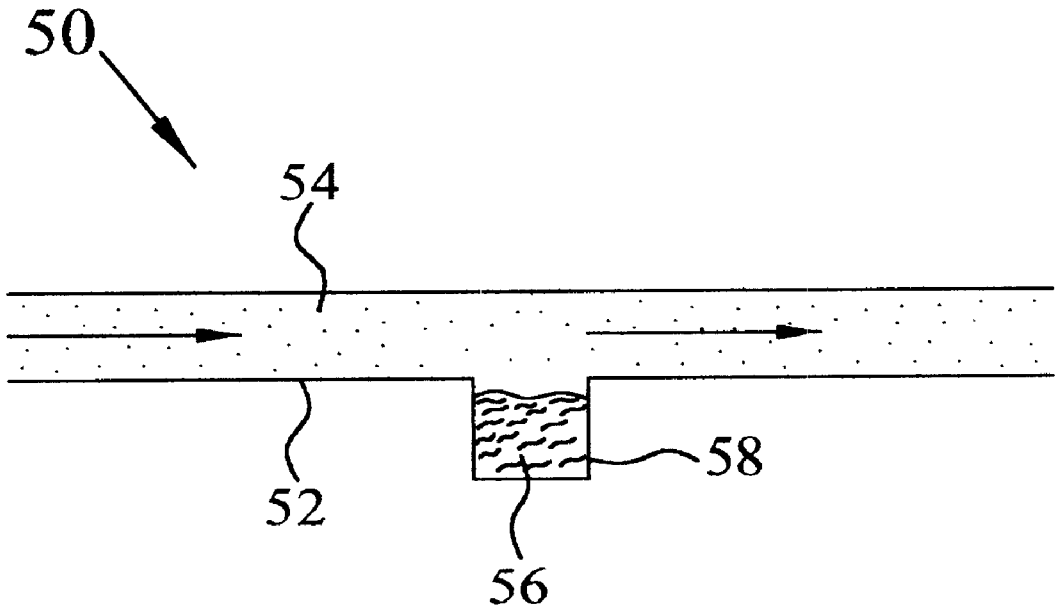

A fifth embodiment of an acceleration responsive switch is shown in FIGS. 5(*a*) and 5(*b*). FIG. 5(*a*) shows a fluidic switch 50 in its closed non fluid flowing condition and FIG. 1(*b*) shows it in its actuated open fluid flowing condition. The fluidic switch 50 includes a tube 52 for conveying a fluid 54. The fluidic switch 50 also includes a material 56 that has the characteristic of changing from a high viscosity (first state) to a low viscosity (second state) in response to acceleration forces. The material 56 is disposed in the tube 52 so that fluid 54 is prevented from flowing through tube 52 while material 56 is in its first state, keeping switch 50 in its closed condition. When the fluidic switch 50 is subjected to acceleration forces, material 56 changes to its second state and flows out of tube 52 and into a reservoir 58 so that fluid 54 may flow freely through tube 52, changing switch 50 to its open condition.

Figure 6A:
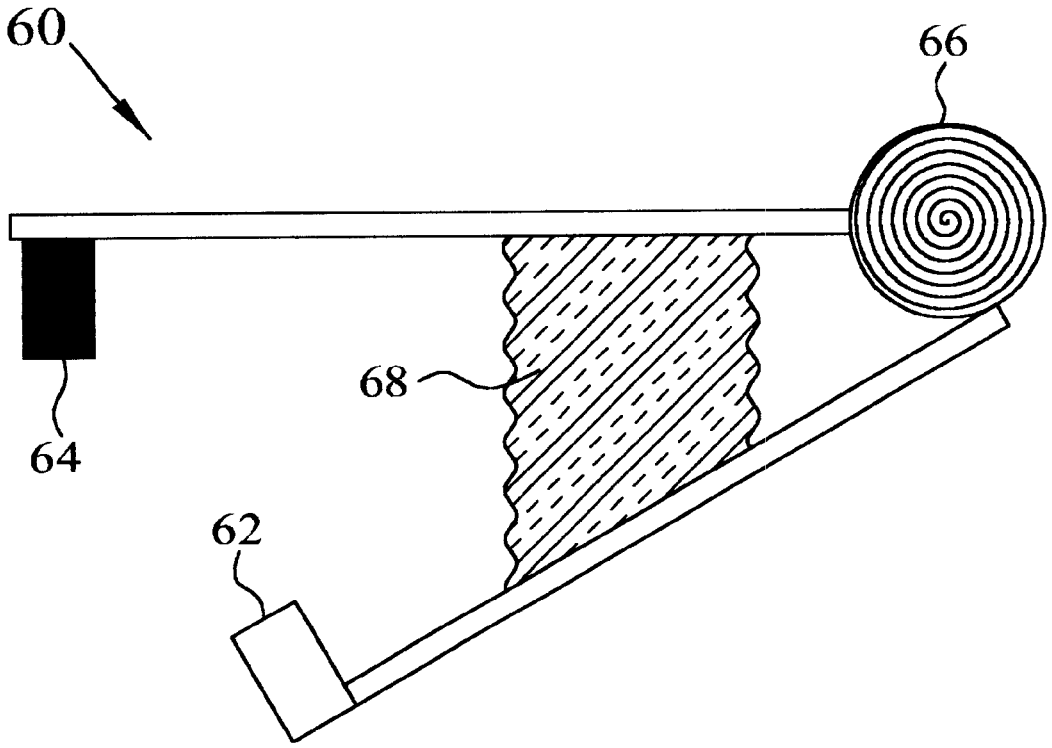
FIGS. 6(*a*) and 6(*b*) are diagrams showing the open and closed conditions, respectively, of a sixth acceleration responsive switch.
Figure 6B:
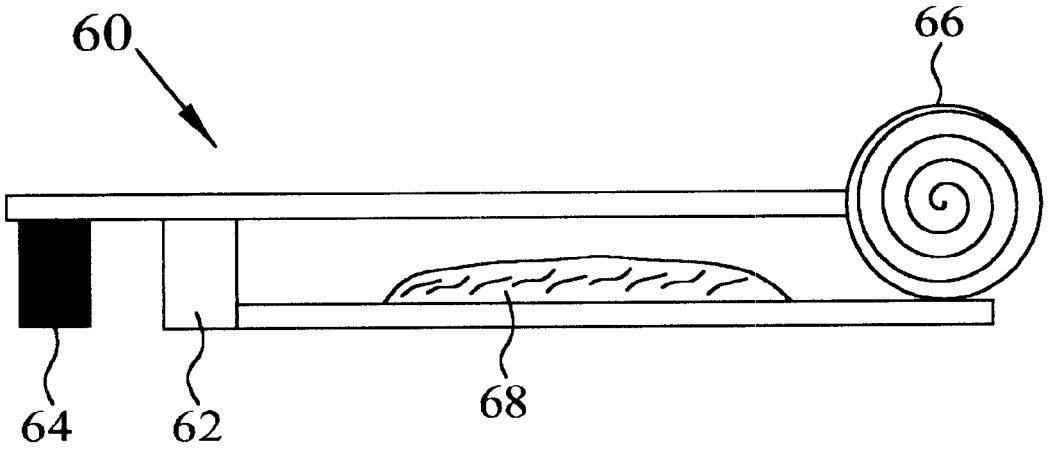

A sixth embodiment of an acceleration responsive switch is shown in FIGS. 6(*a*) and 6(*b*). FIG. 6(*a*) shows a magnetic switch 60 in its normally open condition and FIG. 6(*b*) shows it in its actuated closed condition. Magnetic switch 60 includes a movable magnet 62 that is movable from a first position, as shown in FIG. 6(*a*), to a second position, as shown in FIG. 6(*b*). Magnetic switch 60 also includes a magnetic sensor 64 for detecting magnet 62 when it is in its second position. Magnetic switch 60 further includes a mechanism for biasing magnet 62 towards its second position. By way of example, a spring 66 is attached to magnet 62 so that magnet 62 is biased towards magnetic sensor 64. Also included is a material 68 that has the characteristic of changing from a high viscosity (first state) to a low viscosity (second state) in response to acceleration forces. The material 68 is disposed so that it prevents the magnet 62 from moving to its second position, while material 68 is in its first state, keeping switch 60 in its open condition. When the magnetic switch 60 is subjected to acceleration forces, material 68 changes to its second state and allows magnet 62 to move to its second position, changing switch 60 to its closed condition.

Figure 7A:
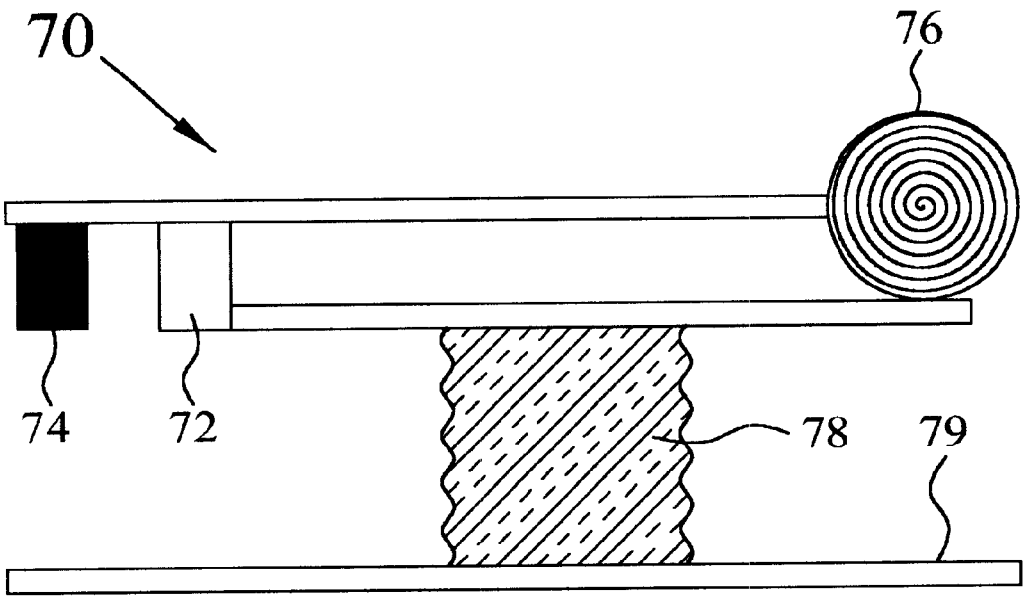
FIGS. 7(*a*) and 7(*b*) are diagrams showing the closed and open conditions, respectively, of a seventh acceleration responsive switch.
Figure 7B:
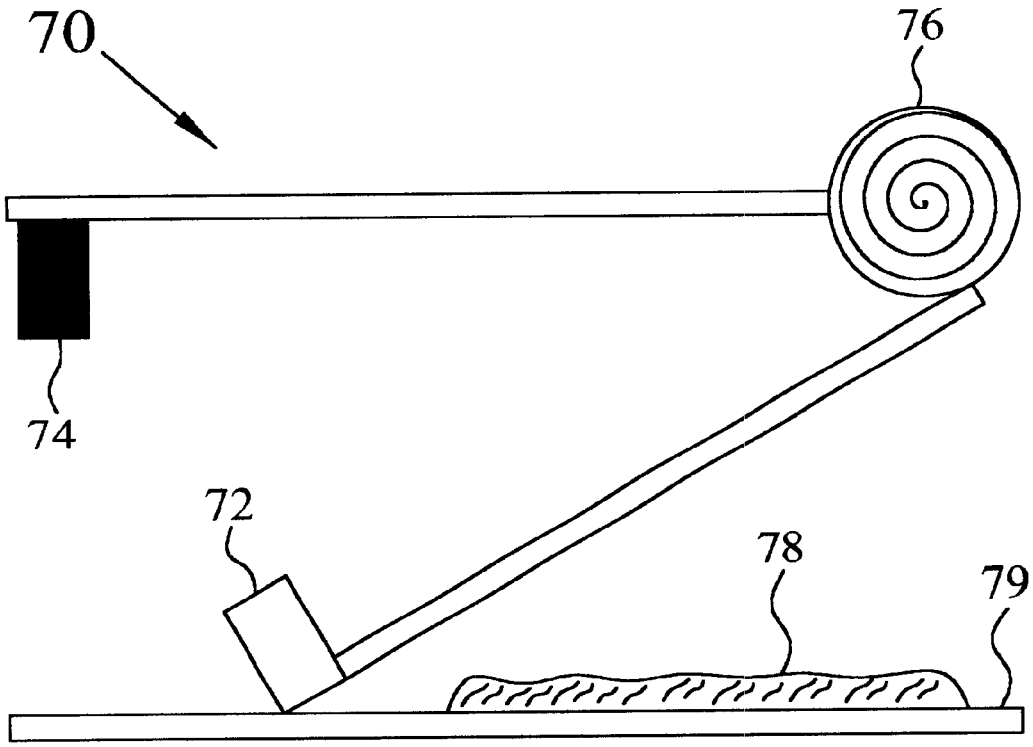

A seventh embodiment of an acceleration responsive switch is shown in FIGS. 7(*a*) and 7(*b*). FIG. 7(*a*) shows a magnetic switch 70 in its normally closed condition and FIG. 7(*b*) shows it in its actuated open condition. Magnetic switch 70 includes a movable magnet 72 that is movable from a first position, as shown in FIG. 7(*a*), to a second position, as shown in FIG. 7(*b*). Magnetic switch 70 also includes a magnetic sensor 74 for detecting magnet 72 when it is in its second position. Magnetic switch 70 further includes a mechanism for biasing magnet 72 towards its second position. By way of example, a spring 76 is attached to magnet 72 so that magnet 72 is biased towards magnetic sensor 74. Also included is a material 78 that has the characteristic of changing from a high viscosity (first state) to a low viscosity (second state) in response to acceleration forces. The material 78 is disposed, so that it prevents the magnet 72 from moving to its second position, while material 78 is in its first state, keeping switch 70 in its closed condition. By way of example, FIG. 7(*a*) shows material 78 between magnet 72 and switch housing 79. When the magnetic switch 70 is subjected to acceleration forces, material 78 changes to its second state and allows magnet 72 to move to its second position, changing switch 70 to its open condition.

Figure 8A:
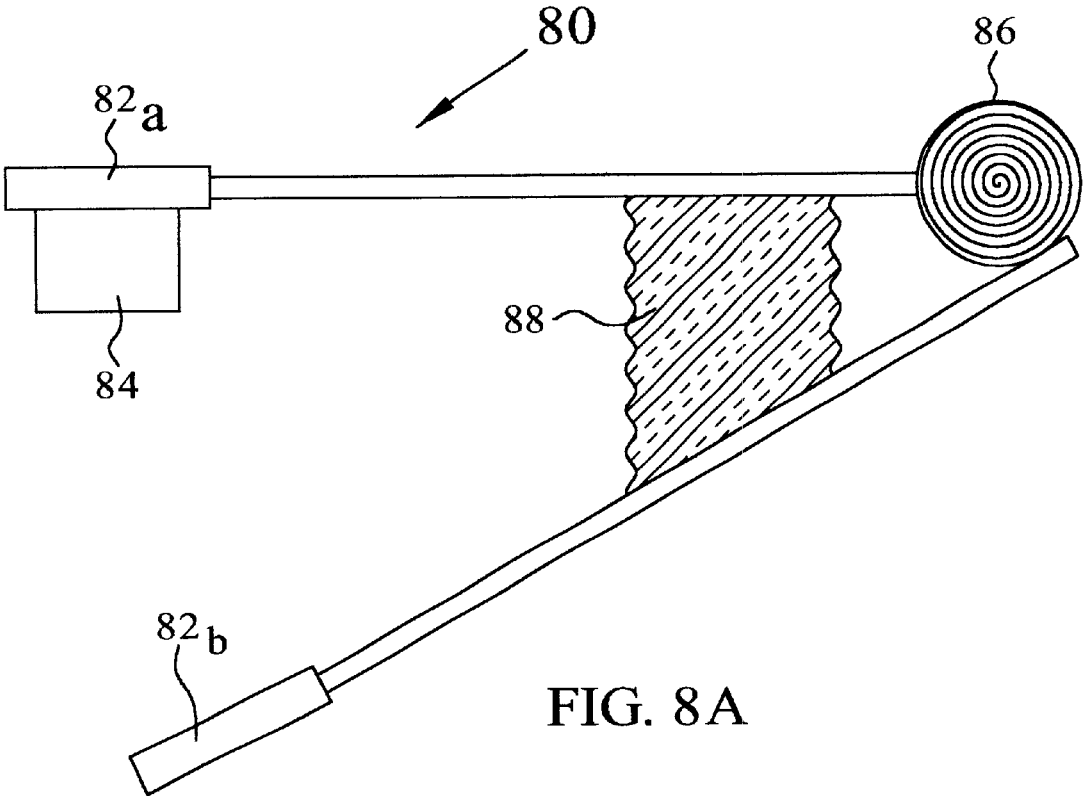
FIGS. 8(*a*) and 8(*b*) are diagrams showing the first and second conditions, respectively, of an eighth acceleration responsive switch.
Figure 8B:
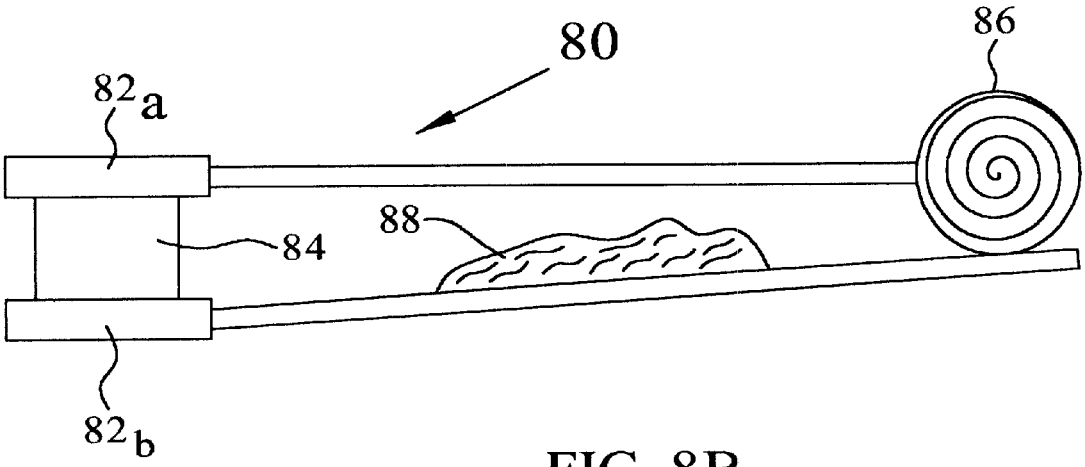

An eighth embodiment of an acceleration responsive switch is shown in FIGS. 8(*a*) and 8(*b*). FIG. 8(*a*) shows a capacitive switch 80 in its first condition and FIG. 8(*b*) shows it in its second condition. The capacitance of the switch 80 in its second condition (FIG. 8(*b*)) is higher than capacitance of the switch 80 in its first condition (FIG. 8(*a*)). Capacitive switch 80 includes conductive plates 82*a* and 82*b*, facing and spaced apart. Second conductive plate 82*b* is movable from a first position, as shown in FIG. 8(*a*), to a second position, as shown in FIG. 8(*b*), where the distance between the plates when in the second position is less than the distance between plates when in the first position. Capacitive switch 80 further includes a dielectric material 84 disposed between the conductive plates. By way of example, dielectric material 84 may be air or other electrical insulator. A mechanism for biasing the second conductive plate 84 towards its second position is also included in the switch. By way of example, FIGS. 8(*a*) and 8(*b*) show a spring 86 attached to second conductive plate 84, biasing it towards its second position.

Still referring to FIGS. 8(*a*) and 8(*b*), capacitive switch 80 further includes a material 88, that changes from a high viscosity (first state) to a low viscosity (second state) in response to acceleration forces. The material 88 is disposed so that it prevents the second conductive plate 82*b* from moving to its second position, while material 88 is in its first state. By way of example, FIG. 8(*a*) shows material 88 disposed between the first conductive plate 82*a* and second conductive plate 82*b*, keeping second conductive plate 82*b* in its first position and thus keeping the capacitive switch 80 in its first (low capacitance) condition. When the capacitive switch 80 is subjected to acceleration forces, material 88 changes to its second state and second conductive plate 82*b* is allowed to move to its closed position, as shown in FIG. 8(*b*), so that switch 80 changes to its second (higher capacitance) condition.

Figure 9A:
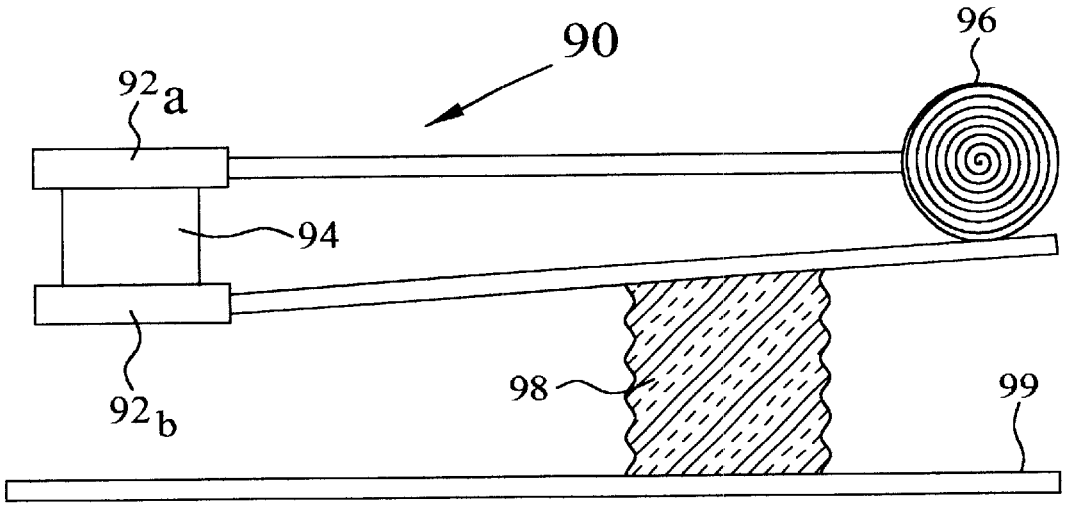
FIGS. 9(*a*) and 9(*b*) are diagrams showing the first and second conditions, respectively, of a ninth acceleration responsive switch.
Figure 9B:
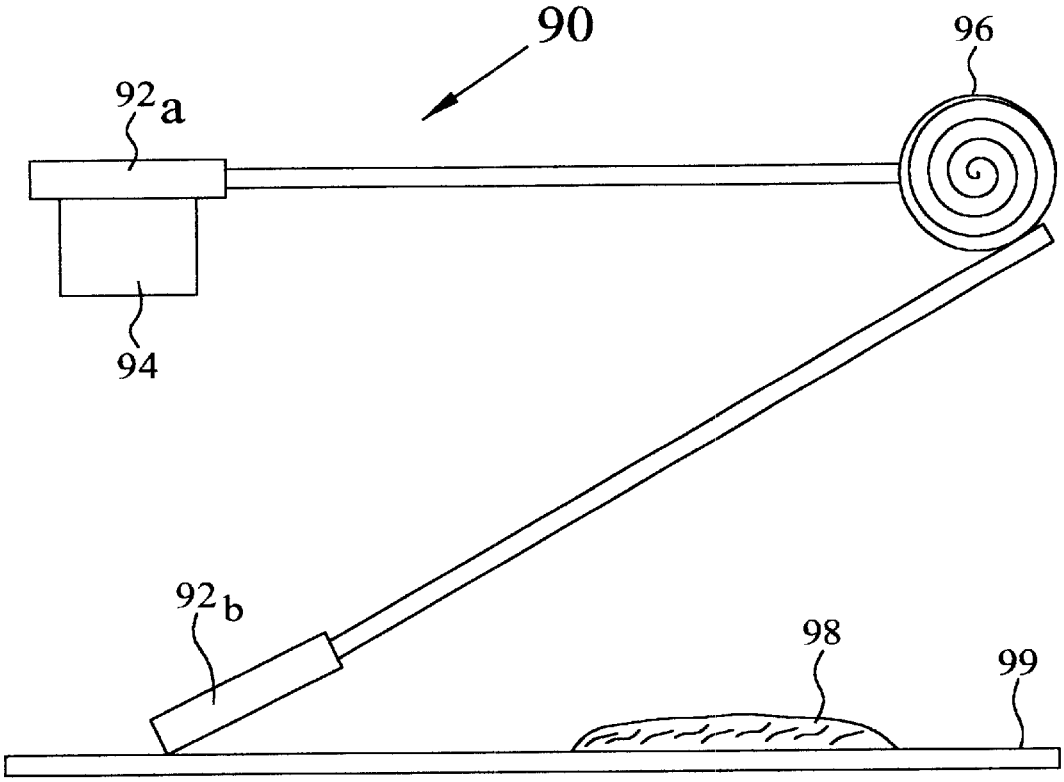

A ninth embodiment of an acceleration responsive switch is shown in FIGS. 9(*a*) and 9(*b*). FIG. 9(*a*) shows a M capacitive switch 90 in its first condition and FIG. 9(*b*) shows it in its second condition. The capacitance of the switch 90 in its second condition (FIG. 9(*b*)) is lower than capacitance of the switch 90 in its first condition (FIG. 9(*a*)). Capacitive switch 90 includes conductive plates 92*a* and 92*b*, facing and spaced apart. Second conductive plate 92*b* is movable from a first position, as shown in FIG. 9(*a*), to a second position, as shown in FIG. 9(*b*), where the distance between the plates when in the second position is greater than the distance between plates when in the first position. Capacitive switch 90 further includes a dielectric material 94 disposed between the conductive plates. A mechanism for biasing the second conductive plate 92*b* towards its second position is also included in the switch 90. By way of example, FIGS. 9(*a*) and 9(*b*) show a spring 96 attached to second conductive plate 92*b*, biasing it towards its second position.

Still referring to FIGS. 9(*a*) and 9(*b*), capacitive switch 90 further includes a material 98, that changes from a high viscosity (first state) to a low viscosity (second state) in response to acceleration forces. The material 98 is disposed so that it prevents the second conductive plate 92*b* from moving to its second position, while material 98 is in its first state. By way of example, FIG. 9(*a*) shows material 98 disposed between the first conductive plate 92*b* and a switch housing 99, keeping second conductive plate 92*b* in its first position and thus keeping the capacitive switch 90 in its first (higher capacitance) condition. When the capacitive switch 90 is subjected to acceleration forces, material 98 changes to its second state and second conductive plate 92*b* is allowed to move to its closed position, as shown in FIG. 9(*b*), so that switch 90 changes to its second (lower capacitance) condition.

Figure 10A:
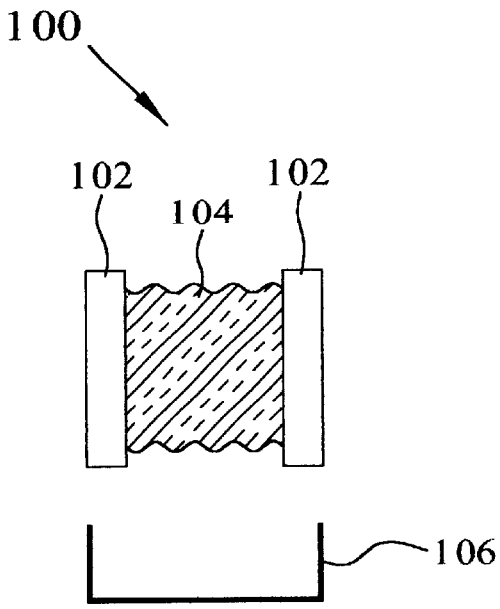
FIGS. 10(*a*) and 10(*b*) are diagrams showing the first and second conditions, respectively, of a tenth acceleration responsive switch.
Figure 10B:
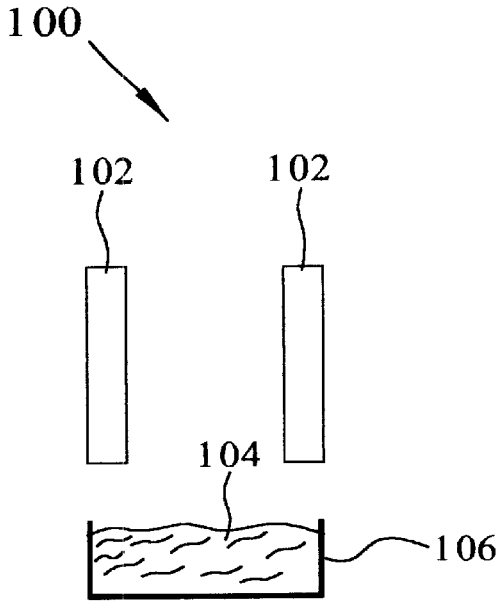

A tenth embodiment of an acceleration responsive switch is shown in FIGS. 10(*a*) and 10(*b*). FIG. 10(*a*) shows a capacitive switch 100 in its first condition and FIG. 10(*b*) shows it in its second condition. The capacitance of the switch 100 in its second condition (FIG. 10(*b*)) is lower than capacitance of the switch 100 in its first condition (FIG. 10(*a*)). Capacitive switch 100 includes conductive plates 102, facing and spaced apart. The switch 100 also includes a non-conductive material 104, that changes from a high viscosity (first state) to a low viscosity (second state) in response to acceleration forces. The material 104 is disposed between conductive plates 102 while material 104 is in its first state, so that switch 100 stays in its first (higher capacitance) condition. When subjected to acceleration forces, non-conductive material 104 changes to its second state and flows to a location outside of conductive plates 102, so that non-conductive material 104 is no longer between conductive plates 102 and switch 100 changes to its second (lower capacitance) condition. By way of example, non-conductive material 104 flows to switch housing 106 when subjected to acceleration forces, as shown in FIG. 10(*b*).

Figure 11A:
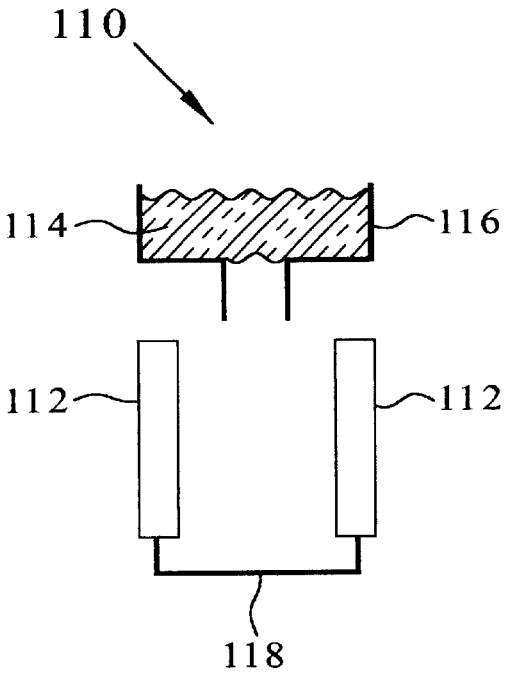
FIGS. 11(*a*) and 11(*b*) are diagrams showing the first and second conditions, respectively, of an eleventh acceleration responsive switch.
Figure 11B:
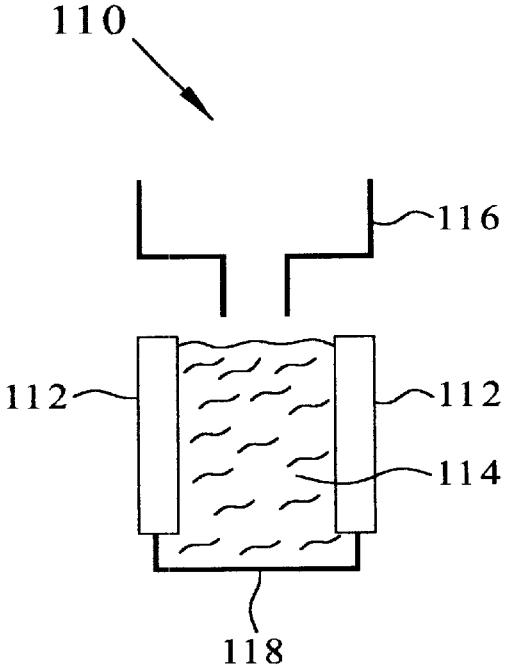

An eleventh embodiment of an acceleration responsive switch is shown in FIGS. 11(*a*) and 11(*b*). FIG. 11(*a*) shows a capacitive switch 110 in its first condition and FIG. 11(*b*) shows it in its second condition. The capacitance of the switch 110 in its second condition (FIG. 11(*b*)) is higher than capacitance of the switch 110 in its first condition (FIG. 11(*a*)). Capacitive switch 110 includes conductive plates 112, facing and spaced apart. Also included is non-conductive material 114, which like the previous material changes viscosity in response to acceleration forces. FIG. 11(*a*) shows non-conductive material 114 retained to a first location, outside of conductive plates 112, by a first reservoir 116. Non-conductive material 114 remains in reservoir 116 while non-conductive material 114 is in its first state, keeping switch 110 in its first (lower capacitance) condition. When subjected to acceleration forces, non-conductive material 114 changes to its second state and flows to a second location, between conductive plates 112, so that switch 110 changes to its second (higher capacitance) condition. Switch 110 optionally includes a second reservoir 118 for retaining non-conductive material 114 to its second location.

I claim:

1. A method of changing a switch between a first and a second condition in response to an acceleration force, said method comprising the step of disposing in said switch, a material that changes from a first state to a second state in response to said acceleration force, the viscosity of said material in said second state being lower than the viscosity in said first state, such that said change from said first state to said second state results in said changing of said switch between said first and second conditions.

2. The method as recited in claim 1, wherein said switch is an electrical switch, providing an electrical path when in one said condition and interrupting said electrical path when in the other said condition.

3. The method as recited in claim 1, wherein said switch is a fluidic switch, preventing fluid flow when in one said condition and allowing fluid flow when in the other said condition.

4. The method as recited in claim 1, wherein said switch is a capacitive switch, wherein said switch has a first capacitance in one said condition and a second capacitance in the other said condition, said second capacitance being different than said first capacitance.

5. A switch that changes between a first and a second condition in response to an acceleration force, said switch comprising a material that changes from a first state to a second state in response to said acceleration force, the viscosity of said material in said second state being lower than the viscosity in said first state, such that said change from said first state to said second state results in said changing of said switch between said first and second conditions.

6. A switch as recited in claim 5, wherein said switch is an electrical switch, providing an electrical path when in one said condition and interrupting said electrical path when in the other said condition.

7. A switch as recited in claim 5, wherein said switch is a fluidic switch, preventing fluid flow when in one said condition and allowing fluid flow when in the other said condition.

8. A switch as recited in claim 5, wherein said switch is a capacitive switch, wherein said switch has a first capacitance in one said condition and a second capacitance in the other said condition, said second capacitance being different than said first capacitance.

9. An electrical switch having an open, non-conductive condition and a closed, conductive condition comprising:

(a) a stationary contact; and (b) a material that changes from a first state to a second state in response to acceleration forces, the viscosity of said material in said second state being lower than the viscosity in said first state, said material being located in proximity to said stationary contact for changing said switch from one of its said conditions to the other of its said conditions upon a change of said material from one of its states to the other.

10. An electrical switch as recited in claim 9 wherein said switch is normally in said open, non-conductive condition, and when subjected to said acceleration forces, said switch changes to said closed, conductive condition.

11. An electrical switch as recited in claim 10 further comprising a movable contact, located in proximity to said stationary contact, movable from an open position to a closed position, so that when said movable contact is in said open position said movable contact is electrically isolated from said stationary contact causing said switch to remain in said open, non-conductive condition and when said movable contact moves to said closed position, said movable contact provides the conductive path with said stationary contact so that said switch changes to said closed, conductive condition.

12. An electrical switch as recited in claim 11 wherein said material prevents said movable contact from moving from said open position to said closed position while said material is in said first state, and said material allows said movable contact to move from said open position to said closed position when said material is in said second state.

13. An electrical switch as recited in claim 12 further comprising a mechanism for biasing said movable contact towards said closed position.

14. An electrical switch as recited in claim 13 wherein said biasing mechanism is a spring operably coupled to said movable contact.

15. An electrical switch as recited in claim 10 wherein said material is conductive.

16. An electrical switch as recited in claim 15 further comprising a reservoir located in proximity to said stationary contact, for retaining and electrically isolating said material from said stationary contact while said material is in said first state, so that said switch remains in said open, non-conductive condition, and for allowing said material to flow out of said reservoir and into electrical contact with said stationary contact when said material changes to said second state, wherein said material provides the conductive path so that said switch changes to said closed, conductive condition.

17. An electrical switch as recited in claim 9 wherein said switch is normally in said closed, conductive condition, and when subjected to said acceleration forces, said switch changes to said open, non-conductive condition.

18. An electrical switch as recited in claim 17 further comprising a movable contact, located in proximity to said stationary contact, movable from a closed position to an open position, so that said movable contact provides the conductive path with said stationary contact when in said closed position causing said switch to remain in said closed, conductive condition and when said movable contact moves to said open position said movable contact interrupts said conductive path causing said switch to change to said open, non-conductive condition.

19. An electrical switch as recited in claim 18 wherein said material prevents said movable contact from moving from said closed position to said open position while said material is in said first state, and said material allows said movable contact to move from said closed position to said open position when said material is in said second state.

20. An electrical switch as recited in claim 19 further comprising a mechanism for biasing said movable contact towards said open position.

21. An electrical switch as recited in claim 20 wherein said biasing mechanism is a spring operably coupled to said movable contact.

22. An electrical switch as recited in claim 17 wherein said material is conductive.

23. An electrical switch as recited in claim 22 wherein said material provides the conductive path with said stationary contact while said material is in said first state, so that said switch remains in said closed, conductive condition, and said material flows out of contact with said stationary contact, interrupting said conductive path when said material changes to said second state, so that said switch changes to said open, non-conductive condition.

24. A magnetic switch having an open condition and a closed condition comprising:

(a) a magnet, movable from a first position to a second position;

(b) a magnetic sensor, for detecting said magnet when said magnet is in one of its said positions;

(c) a material that changes from a first state to a second state in response to acceleration forces, the viscosity of said material in said second state being lower than the viscosity in said first state, said material for preventing said magnet from moving from its said first position to its said second position while said material is in said first state, and said material for allowing said magnet to move from said first position to said second position when said material is in its said second state.

25. A magnetic switch as recited in claim 24, further comprising a mechanism for biasing said magnet towards its said second position.

26. A magnetic switch as recited in claim 25, wherein said biasing mechanism is a spring operably coupled to said magnet.

27. A fluidic switch having an open, fluid flowing condition and a closed, non-fluid flowing condition comprising:

(a) a tube for conveying a fluid; and (b) a material that changes from a first state to a second state in response to acceleration forces, the viscosity of said material in said second state being lower than the viscosity in said first state, said material being located in proximity to said tube for changing said switch from one of its said conditions to the other of its said conditions upon a change of said material from one of its states to the other.

28. A fluidic switch as recited in claim 27, further comprising a reservoir coupled to said tube.

29. A fluidic switch as recited in claim 28, wherein said material is located in said tube while said material is in its said first state, so that said switch remains in said closed, non-fluid flowing condition, and wherein said material flows into said reservoir when said material changes to said second state, so that said switch changes to said open, fluid flowing condition.

30. A capacitive switch having a first and second condition, the capacitance of said capacitive switch being different in said second condition than in said first condition, said capacitive switch comprising:

(a) a first conductive plate;

(b) a second conductive plate, disposed facing and spaced apart from said first conductive plate; and (c) a material that changes from a first state to a second state in response to acceleration forces, the viscosity of said material in said second state being lower than the viscosity in said first state, said material being located in proximity to said conductive plates for changing said switch from one of its said conditions to the other of its said conditions upon a change of said material from one of its states to the other.

31. A capacitive switch as recited in claim 30, wherein said second conductive plate is movable from a first position to a second position, said second conductive plate being spaced a first distance from said first conductive plate while in said first position, and said second conductive plate being spaced a second distance from said first conductive plate while in said second position, said second distance being different than said first distance.

32. A capacitive switch as recited in claim 31, wherein said material prevents said second conductive plate from moving from said first position to said second position while said material is in its said first state, and said material allows said second conductive plate to move from said first position to said second position when said material is in its said second state.

33. A capacitive switch as recited in claim 32, further comprising a mechanism for biasing said second conductive plate towards its said second position.

34. A capacitive switch as recited in claim 33, wherein said biasing mechanism is a spring operably coupled to said second conductive plate.

35. A capacitive switch as recited in claim 30, wherein said material is substantially non-conductive and is used to change the dielectric of said capacitive switch.

36. A capacitive switch as recited in claim 35, wherein said material is located between said conductive plates while said material is in its said first state, so that said switch remains in its said first condition, and said material flows to a location that is substantially outside of said conductive plates, so that said switch changes to its said second condition.

37. A capacitive switch as recited in claim 35, further comprising a reservoir located in proximity to said stationary contact, for retaining said material to a first location that is outside of said conductive plates, so that said switch remains in its said first condition, and for allowing said material to flow out of said reservoir and into a second location between said conductive plates when said material changes to its said second state, so that said switch changes to its said second condition.

* * * * *